US008599039B2

(12) United States Patent
Otero et al.

(10) Patent No.: US 8,599,039 B2
(45) Date of Patent: Dec. 3, 2013

(54) WIRELESS TRAFFIC CALMING, CAUTIONING, EARLY WARNING AND EMERGENCY NOTIFICATION SYSTEM

(75) Inventors: Arthur R. Otero, Granada Hills, CA (US); Michael A. Ragosta, Granada Hills, CA (US)

(73) Assignee: Autostop Technology, LLC, Granada Hills, CA (US)

( * ) Notice: Subject to any disclaimer, the term of this patent is extended or adjusted under 35 U.S.C. 154(b) by 243 days.

(21) Appl. No.: 13/149,678

(22) Filed: May 31, 2011

(65) Prior Publication Data

US 2011/0227756 A1 Sep. 22, 2011

Related U.S. Application Data

(63) Continuation-in-part of application No. 11/406,024, filed on Apr. 17, 2006, now abandoned.

(51) Int. Cl.
*G08G 1/09* (2006.01)

(52) U.S. Cl.
USPC ..... 340/905; 340/901

(58) Field of Classification Search
USPC ..... 340/905
See application file for complete search history.

(56) References Cited

U.S. PATENT DOCUMENTS

| | | | | |
|---|---|---|---|---|
| 5,649,300 | A | 7/1997 | Snyder et al. | |
| 5,784,006 | A * | 7/1998 | Hochstein | 340/905 |
| 5,900,825 | A | 5/1999 | Pressel et al. | |
| 6,222,461 | B1 | 4/2001 | Hazen | |
| 6,441,748 | B1 | 8/2002 | Takagi et al. | |
| 6,707,391 | B1 | 3/2004 | Monroe | |
| 6,861,959 | B1 | 3/2005 | Torres Sabate et al. | |
| 6,870,487 | B2 | 3/2005 | Nuesser et al. | |
| 7,046,168 | B2 | 5/2006 | Tsuboi | |
| 7,109,884 | B2 * | 9/2006 | Glynn | 340/907 |
| 7,161,485 | B2 | 1/2007 | Melman | |
| 7,212,989 | B1 * | 5/2007 | Taniguchi | 705/13 |
| 2001/0020902 | A1 | 9/2001 | Tamura | |
| 2005/0278078 | A1 | 12/2005 | Sterling | |

OTHER PUBLICATIONS

"Short-Range Wireless Communication" by Alan Bensky, Published by Elsevier, 2004, p. 3.

* cited by examiner

*Primary Examiner* — Kerri McNally
(74) *Attorney, Agent, or Firm* — Blakely Sokoloff Taylor & Zafman

(57) ABSTRACT

A traffic calming (broadly defined as methods and apparatus for the purpose of reducing or otherwise controlling vehicle speeds and improving safety appropriate to the state of the road), cautioning, early warning and emergency notification system using secure wireless transmitters, receivers and transceivers for localized point to point notification. Static, desktop, portable and vehicle mounted transmitters/transceivers are automatically or manually triggered to transmit cautioning, early warning or emergency alert messages within a specified range to desktop, portable or vehicular-mounted receivers/transceivers, notifying the user of the receiver/transceiver of an approaching traffic calming or cautioning situation (children crossing, train crossing, construction detour, accident scene, etc.) or emergency situation (approaching emergency responder vehicle, such as police, firefighters, ambulance, etc). The system utilizes secure, localized point-to-point wireless technology to overcome typical impediments to effective targeted traffic calming, cautioning, early warning and emergency notification at home, work and in a vehicle by allowing emergency responders and others responsible for cautioning, early warning and emergency notification, who have one or more transmitter/transceiver, to communicate directly and effectively with the immediately affected individual(s) within a specified range, who have at least one receiver/transceiver.

24 Claims, 4 Drawing Sheets

WIRELESS TRAFFIC CALMING, CAUTIONING, EARLY WARNING AND EMERGENCY NOTIFICATION SYSTEM

CROSS-REFERENCE TO RELATED APPLICATION

The present patent application is a Continuation-in-Part application claiming the benefit of application Ser. No. 11/406,024, filed Apr. 17, 2006 now abandoned.

FIELD OF INVENTION

The present invention relates to a wireless communication system. In particular, the present invention relates to a method and apparatus for providing secure, localized point-to-point traffic calming, cautioning, early warning and emergency notification in a vehicle or building within a specified range through any communication device capable of wireless communication.

STATE OF THE ART

State of the art recognizes that one can be made aware of, i.e. 'alerted to', a public cautionary or emergency condition affecting the safety of an individual or group of pedestrians, vehicle drivers, occupants of buildings or a community at large, via external visual and/or audible alarms.

State of the art emergency alerts typically emanate from an external static alert system, such as area wide systems like the 'Public Warning Siren System', localized visual and audible alert systems like railroad crossing flashing lights and clanging bells, etc., or from the manually triggered, vehicle-mounted flashing lights and siren of an approaching civil service emergency vehicle (police, fire fighters, paramedics, etc.).

State of the art also recognizes that general transmission of emergency situations can be transmitted throughout an affected area via existing public radio or television transmits in conjunction with the emergency transmit network.

State of the art cautionary or warning alerts are typically accomplished by static and/or active signage (e.g. flashing lights), such as those put in place temporarily because of road construction or a special event, etc., and sometimes by using individuals holding warning signs and otherwise making affected pedestrians and vehicle drivers aware of an impending caution, detour, etc.

State of the art also recognizes that select transmissions of cautioning, early warning and emergency situations can be transmitted to trained civil servants and related professionals throughout an affected area via a dedicated network of mobile radio equipment, as well as individual walkie-talkies, cellphones, etc.

State of the art in vehicular telematics (e.g. General Motors V2V) recognizes that road condition information from intelligent transportation systems, where available, may be received by an on-board vehicle application-specific computer, combined with an on-board global positioning system (GPS) to be used for early warning and emergency notification of the driver of an approaching incident on the road or in the area.

These various state of the art methods and apparatus for communicating cautioning, early warning and emergency notifications alert messages can be used individually or in any combination to reach the affected parties, but each, whether used individually and in combination, are characterized by one or more fundamental limitations to their effectiveness in reaching the affected parties. Specifically, with the exception of vehicular telematics systems, they all require the targeted parties to be receptive or attentive to the potential cautioning, early warning and emergency notification. This typically means getting the attention of an affected individual or group that is otherwise occupied and often insulated to the method or apparatus being used to communicate the cautioning, early warning and emergency notification, i.e. the static or flashing sign is not readily visible, the siren cannot be heard, the radio or television is not turned on, the particular communication service is not available or even the most basic electrical power grid and infrastructure to support typical communication devices is not available. In the case of vehicular telematics, the overall effectiveness in notifying all effected parties is dependent upon the installation of comprehensive local, state and/or nationwide intelligent transportation systems that are able to communicate with all on-board computer regardless of vehicle make or model. Quite apart from the steep technological and infrastructure hurdles attending any widespread use of this approach, it is wholly dependent upon the operational integrity of the intelligent transportation system and the key elements of its enabling infrastructure and support technology be it WLAN, WMAN, GPS satellites or basic electrical power grid.

It is recognized that a method or apparatus that is not subject to these limitations and is further able to securely communicate a timely cautioning, early warning or emergency notification alert message selectively and effectively to only those individuals directly affected by the same, without requiring extraordinary or even particular attentiveness or action on their part, would be advantageous in improving the safety and management of cautioning and emergency situations for all involved, civilians and civil servants. In addition, it would be advantageous to provide such a method and apparatus that does not require a new technological or administrative infrastructure, such as intelligent transportation systems, that can be readily implemented at an acceptable initial and ongoing cost, and that is inherently reliable, secure and maintenance free.

BACKGROUND OF THE INVENTION

Personal and commercial transportation vehicles such as automobiles, trucks and motorcycles are being built to achieve increasing levels of driver and passenger comfort, such that shock, vibration and exterior road noise are all but eliminated from the interior compartment. State-of-the-art, high performance radios, CD and DVD players with surround-sound and multiple speakers and powerful subwoofers are increasingly common in most vehicles to better entertain and further mask virtually all exterior interferences to rider comfort and pleasure. The ubiquity of integral and portable communication devices, such as cellular telephones and increasingly sophisticated telematics such as GPS, further serve to preoccupy and distract drivers and passengers on our increasingly congested roads. Even motorcyclists can now purchase sophisticated and powerful audio, communication and navigation systems that serve to isolate the rider even more than what is already the case due to wearing a helmet. These facts, combined with the growing number of aging and infirmed drivers with impaired hearing and vision, as well as adverse environmental factors such inclement weather and glaring sun, make the difficult and dangerous business of effective road cautions and emergency vehicle response that much more difficult and dangerous.

This invention anticipates a comprehensive, separately attached, integrated or stand-alone, secure localized point-to-point wireless communication system designed to address those and other difficulties, improving awareness of road cautions and reducing emergency vehicle response time, thus improving overall safety of everyone affected by the alert situation, while minimizing the risk of personal injury and property damage, particularly while in a moving vehicle.

This invention further anticipates a wireless communication traffic calming, cautioning, early warning and emergency notification system that when activated, as either a stand-alone unit or as a separately attached or integrated unit which 'commandeers' an available computer or audio/video system with one or more speakers, interrupting radio, television, audio or video tape, CD or DVD playback to transmit an 'alert notification' message (pre-configured or, with a manual override transmitter system, custom message) is able to communicate point-to-point with any vehicle or fixed location (personal or commercial residence or business facility) within a pre-defined or specified perimeter, giving affected individuals an audio and/or visual warning (using existing speakers and/or separate speakers and/or a separate display indicator (e.g. LED, LCD) or panel (e.g. 2 line.times.14 character dot-matrix vacuum fluorescent flat panel display), or a.c. thin-film electroluminescent (ACTFEL) display as to the nature of the potential hazard or caution.

This invention further anticipates that this wireless functionality can be provided as an add-on unit or integral functionality to any electronic, computer or audio/video system for vehicles, residences and businesses for cautioning, early warning and emergency alert notifications, whether host system is on or not.

SUMMARY OF THE INVENTION

In accordance with the present invention, a system for providing secure localized point-to-point (i.e. self-contained, self powering and requiring no separate infrastructure for function) wireless communication of traffic calming, cautioning, early warning and emergency notification alert messages is provided. The disclosed system generally include transmitters, receivers, transceivers and transceiver repeaters which function as independent point-to-point wireless communication devices.

The wireless communication between transmitter(s), receiver(s), transceiver(s) and transceiver repeater(s) can be accomplished by, but is not limited to, using AM, FM, PCM, Laser, IR and RF technology.

One technological approach that would offer an optimum embodiment of the present invention for localized, point-to-point wireless communication for the purpose of traffic calming, cautioning, early warning and emergency notification alert messages is called ZigBee, which is a published specification set of high level communication protocols designed to use small, low power digital radios based on the IEEE 802.15.4 standard for wireless personal area networks (WPANs). A typical ZigBee system can transmit at a data rate up to approximately 500 kilobits per second to a range of approximately 500 meters.

Transmitter, Transceivers and Transceiver Repeater Embodiments

Transmitters, transceivers and transceivers repeaters are adapted for Desktop, Portable, Static and Vehicular Mounting.

Static-mounted transmitters, transceivers and transceiver repeaters are stationary devices of the present invention that are adapted to use available power or are adapted to have self-contained dry cell or rechargeable batteries utilizing solar power or other effective localized recharging. They are adapted to mount anywhere, including buildings and signs, as well as utility, street-lighting and traffic-signal poles, or any other temporary and permanent stationary traffic calming locations (i.e. with the required proximity for the intended traffic calming, cautioning, early warning and emergency notification purpose.

Static-mounted transmitters, transceivers and transceiver repeaters are adapted for wireless communication with Desktop, Portable and Vehicular-Mounted Receivers and transmit pulsed warnings or alarms or audible and/or displayed message(s) for the specific required circumstance(s), such as:

Slow—Children Are Present

Prepare To Stop

Damage to Road—Please Use Caution

Static-mounted transmitters, transceivers and transceiver repeaters can be adapted and preset to communicate with vehicular-mounted receivers at different distances and times (with built-in looping and preset delays, if and as appropriate, or via special programming). Static-mounted transmitters can also have multiple, automatic, integral, remote and/or manual triggers for various fixed or custom messages.

Fixed Static-mounted transmitters and transceivers located at a school can be adapted to have automatic 'alert' triggers for different times of the day when children will be arriving to and leaving from school. They can also be adapted to have motion sensing triggers located such that a certain level of pedestrian foot traffic, apart from a specific time of day, would trigger a specific caution alert, and so on.

In addition, a fixed static-mounted transmitter/transceiver located at a school can be adapted as a single system or used in conjunction with a Transceiver Repeater adapted to have manual triggering and multiple ranges for a wider transmit distance and a special programmable messages and trigger times for special events, for example: 'Caution: Special Event In Progress. Watch for Children'.

Portable Static-Mounted Transmitters/Transceivers can be adapted for location at construction sites or for any special event and provide for different alert messages at different distances, for example: 'Highway Construction 500 Feet Ahead, Please Use Caution'.

Static-Mounted Transmitters/Transceivers can be adapted for installation in single or multiple locations at recreational parks to provide for caution messages at different locations where vehicular and/or pedestrian traffic flow necessitates cautioning.

Static-Mounted Transmitters, Transceivers and Transceiver Repeaters can be adapted for installation in single or multiple locations with different ranges at hospitals for example to provide fixed and variable, automatic and manual caution messages at different locations, where normal and varying emergency vehicular and/or pedestrian traffic flow necessitates various kinds and combinations of cautioning, such as: 'Proceed With Caution—Hospital Zone' and 'Slow Speed—Watch For Approaching Emergency Vehicle'.

Static-mounted transmitters/transceivers with different ranges can be adapted for installation at Railroad Crossings for example to provide fixed and variable, automatic and manual caution messages, where different trains such as high speed commuters types or slower, longer cargo trains would benefit from different cautioning messages, such as: 'Prepare To Stop For High Speed Metro Train . . . Bus . . . . Transit Authority.'

Static-mounted transmitters/transceivers can also be adapted to be manually overridden by a vehicular-mounted transmitter/transceiver device on board the train if a unique situation warranted a special cautioning or emergency message.

Static-mounted transmitters/transceivers can be installed at airports for example to provide manually triggered fixed and custom emergency and caution messages, for example: 'Prepare To Stop For Vehicle Inspection', 'Airport Temporarily Closed' and 'No Stopping Zone.'

Static-mounted transmitters/transceivers can be adapted for installation in areas that have irregular or seasonal problems such as fog and icy road conditions that warrant timely cautioning, such as:

Fog Ahead—Slow Speed to . . .

Icy Road Ahead—Slow Speed to . . .

Approaching cross traffic . . . intersection . . .

Static-mounted transmitters/transceivers and transceiver repeaters can be adapted for temporary installation by emergency responders such as police, fire and EMT personnel in areas where accidents have occurred that warrant timely cautioning, such as:

Accident Ahead—Slow Speed to . . .

Road Closed Ahead—Detour to . . .

Many other permanent and temporary static-mounted transmitter and transmitter repeater can be adapted to address virtually any regular or irregular cautioning or emergency alert situation in any kind of location for any type of traffic. For example: static-mounted transmitter and transmitter repeater can be adapted to alert airplanes, boats and other types of transportation vehicles with alert messages such as:

Airplanes a. CAUTION: High Wires Ahead

Boats a. Watch for Sand Bars

Static-mounted transmitters/transceivers and transceiver repeaters can also be adapted to work in conjunction with other traffic control devices, such as Intersection Signal Lights so that when power is out, or the light is otherwise non-operational, an alert is automatically transmitted to notify approaching vehicles, or Speed Detection Signs to provide an audible or an additional visual alert message regarding excess speed, along with the external visual alert of the roadside Speed Detection Sign's display.

Many other static-mounted, desktop and portable transmitters/transceivers and transceiver repeaters adaptations can be anticipated given the many functional characteristics anticipated by the present invention.

Vehicular-Mounted Transmitters and Transceivers are mobile transmitters and transceivers adapted to use available power when installed in moving vehicles typically used by civil service personnel such as police, sheriff, highway patrol, traffic control, fire and emergency paramedics as well as the military.

In an emergency response situation, the vehicular-mounted transmitter/transceiver installed in an emergency response vehicle (EV) can be adapted to be manually triggered to transmit fixed or variable alert notification messages that are received by desktop, portable and civilian vehicular-mounted (CV) receivers of the present invention to transmit or display fixed or variable audio and/or visual messages, automatically or via manual override as appropriate to the situation.

Vehicular-mounted transmitter/transceivers can be adapted to trans preset or custom audio and visual messages, such as:

Emergency Vehicles Approaching—Slow and Pull To The Side Road

Police In Pursuit—Please Clear The Road

Vehicular-mounted transmitter/transceivers can be adapted to transmit single or multi-range with variable directionality of transmission to provide for a variable alert areas and/or variable alert messages in one or more languages, as appropriate to the emergency.

Vehicular-mounted transmitter/transceivers can be adapted to work separately or in conjunction with the emergency flashing light and siren system of the vehicle by actuating a switch to immediately trigger the transmission of a preset message or messages or manually override presets using a microphone to speak messages directly to the surrounding static or vehicular mounted receivers of the present invention, depending upon the situation.

Vehicular-mounted transmitter/transceivers, in addition to being adapted to having all standard EV receiver functionality, can be adapted to have a manual override multi-range, directional transmitter with a microphone, which allows for specific message transmission to the entire transmit range or selectively or directionally via select range and direction presets.

Further adaptations to vehicular-mounted transmitter/transceivers, such as integration of GPS or other positioning functionality to allow for location information, are also anticipated by the present invention, but all of these types of functional enhancements will always be adapted in such away so as not to compromise the stand-alone (i.e. infrastructure independent) nature of the point-to-point traffic calming, cautioning, early warning and emergency notification functionality of the present invention, likewise for all corresponding receiver/transceiver devices of the present invention. Such location information may, for example, be included in a transmitted message to alert a driver the relative direction of an emergency vehicle.

All desktop, portable and vehicular-mounted transmitters/transceivers and transceiver repeaters of the present invention can be adapted to send, in addition to digitally encoded messages for audio transmit or visual display, digital signals to desktop, portable and vehicular-mounted receivers of the present invention of the most basic, low cost adaptations, which are capable of only pulsed audible (e.g. from a buzzer) and visual indications (e.g. from a single LED) of a warning (slow pulsing) and emergency (fast pulsing) situation.

Receiver and Transceiver Embodiments

Receivers and transceivers of the present invention can be adapted as very low cost devices for receiving simple pulsing audio and visual alert or as full featured systems capable of receiving, transmitting and broadcasting full audio and visual display alert messages.

Receivers and transceivers can be adapted for stand-alone or integrated installation. Stand-alone receiver/transceiver devices can be adapted to have integral buzzers and/or speakers and visual indicators and/or electronic displays. Integrable receiver/transceiver devices can be adapted to be installed in line with an existing electronic speaker system of any kind (e.g. computer, radio, television, etc.). The speaker wires of the existing system connect through the Integrable receiver/transceiver device, between the amplifier and the speakers. When the Integrable receiver/transceiver device of the present invention is activated by receiving a transmitted trigger signal from transmitters/transceivers and transceiver repeaters of the present invention it will override (i.e. mute) the existing system signal transmission to the speakers and deliver the receiver/transceiver device's pre-programmed or custom audio message. A receiver/transceiver can be adapted to have a visual indicator or display feature that will receive a visual alert message, pulsed or text, as well. This receiver/transceiver display option provides an additional alert feature that will be particularly beneficial to the hearing impaired.

Once the alert message has been transmitted by the receiver/transceiver device as prescribed by the transmitters/transceivers and transceiver repeater device, the override of the existing speaker system will end, resuming normal operations.

The present invention anticipates other receiver/transceiver device adaptations that expand its integral performance feature set, such as built-in multi-language display capability.

The present invention anticipates other receiver/transceiver device adaptations that expand its performance feature set with add on functionality, such as separate speaker option, a multi-line visual displays option (e.g. 2.times.14 character segmented or dot matrix VF display) for detailed text messaging and a vibration option (e.g. steering wheel, floor mat or seat mounted vibration elements) as an additional alert method for the hearing impaired.

The present invention anticipates other receiver/transceiver device adaptations that expand its performance feature set by further integration with a host emergency and civilian vehicles, such as the ability of the device of the present invention to be electronically linked to a vehicle's airbag system so that it can be triggered to transmit an "accident" message from the transceiver device of the present invention when the airbags are released.

The present invention anticipates other receiver/transceiver device adaptations that provides for relaying, via transceiver adapted devices of the present invention, wide area transmits of appropriate traffic calming, cautioning, early warning and emergency notification alert messages for wide area events.

Home and business transmitter, receiver, transceiver and transceiver repeater can be adapted as "separate" after-market devices integrated with or incorporated into home or business computer, radio, television and other personal electronic devices or as stand-alone devices, providing all of the cautioning, early warning and emergency alert functionality of the present invention for the home or business environments.

All transmitter, receiver, transceiver and transceiver repeater functionality of the present invention can be adapted to be integrated into any computer, home or vehicular-mounted radio, CD and DVD players or other similar current or future electronic equipment as an expanded part of the standard feature set eliminating the need for installing a separate after-market device of the present invention. This would be accomplished through a licensing arrangement with equipment manufacturers.

All transmitters, receivers, transceivers and transceiver repeaters of the present invention can be adapted to utilize AC and DC power from any source including disposable and rechargeable batteries.

The present invention anticipates other ad hoc alert notification uses such as wide area detour evacuation notification for impending hurricane or terrorist attack where the effectiveness, dependability and availability of other traditional and infrastructure-dependent wide area notification methods are limited or compromised.

DETAILED DESCRIPTION

A system of the present invention generally includes transmitter/transceiver and receiver/transceiver devices capable of secure wireless communication for purposes of independent, point-to-point cautioning, early warning and emergency notification.

Figure 1:
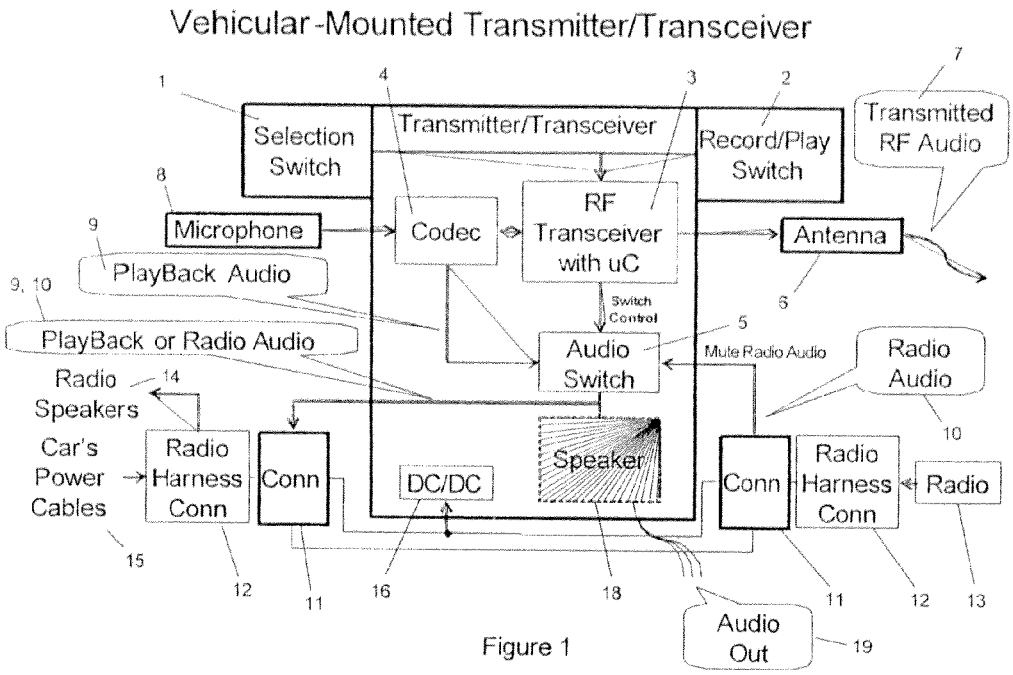
FIG. 1. is a functional block diagram of a Vehicular-Mounted WPAN Embodiment of a Transmitter/Transceiver.

With reference to FIG. 1., a functional block diagram of a typical vehicular-mounted WPAN embodiment of a transmitter/transceiver is depicted. The vehicular-mounted transmitter/transceiver generally has a selection switch 1 and a record/play switch 2. When the selection switch 1 is activated a stored pre-programmed alert message is processed through the transceiver/microcontroller (uC) 3, Codec 4 and audio switch 5 to access and playback audio alert message 9 and then transmit RF audio 7 of the same through the antenna 6 to any system receiver device of the present invention that is within the specified transmit range. Alternatively, when the record/play switch 2 is activated, a custom alert message is spoken into the microphone 8 to be recorded and processed through the transceiver/uC 3, Codec 4 and audio switch 5 and then transmit RF audio 7 through the antenna 6 to any system receiver device of the present invention that is within the specified transmit range. In addition, the transmitter/transceiver can have a provision for playback audio 9 of the custom alert message, prior to transmitting RF audio 7, using a vehicle's radio 13. In this operational mode, the audio switch 5, which is connected to the radio 13 at connector 11 through radio wire harness 12, mutes the radio audio 10 and instead transmits the custom alert message playback audio 9 for playback through the radio speakers 14. Alternatively, the audio switch 5, can be connected to an integral speaker 18, to transmit playback audio 9 alert message for playback as audio out 19 through the integral speaker 18. In this embodiment of the present invention, the vehicular-mounted transmitter/transceiver generally derives power from available vehicle power, which is connected to the transmitter/transceiver DC/DC converter 16 through connector 11 radio wire harness 12 and car power cables 15.

Figure 2:
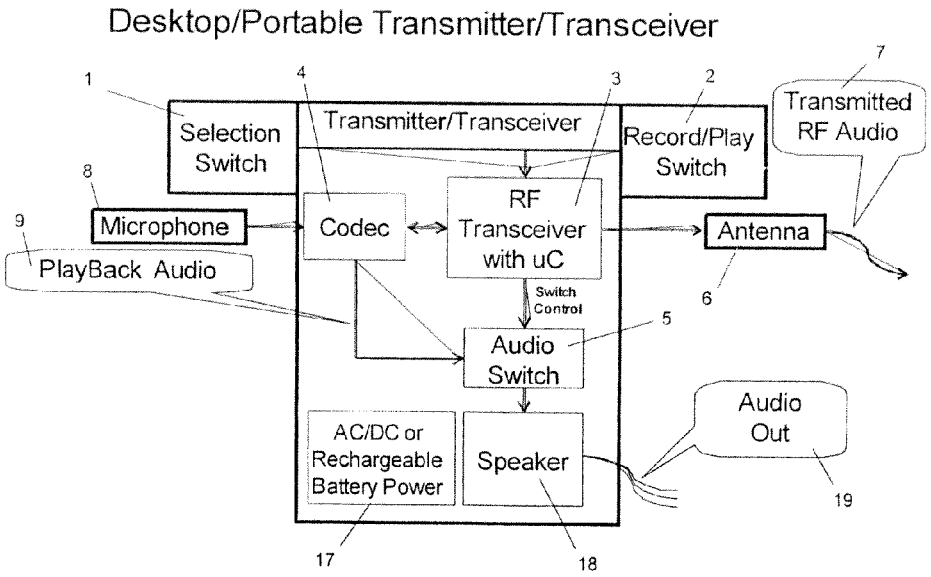
FIG. 2. is a functional block diagram of a Desktop/Portable WPAN Embodiment of a Transmitter/Transceiver.

With reference to FIG. 2., a functional block diagram of a desktop/portable WPAN embodiment of a transmitter/transceiver is depicted. The desktop/portable transmitter/transceiver generally has a selection switch 1 and a record/play switch 2. When the play selection switch 1 is activated a stored pre-programmed alert message is processed through the transceiver/microcontroller (uC) 3, Codec 4 and audio switch 5 to access and playback audio 9 alert message and then transmit RF audio 7 of the same through the antenna 6 to any system receiver device of the present invention that is within the specified transmit range. Alternatively, when the record/play switch 2 is activated, a custom alert message is spoken into the microphone 8 to be recorded and processed through the transceiver/uC 3, Codec 4 and audio switch 5 and then transmit RF audio 7 through the antenna 6 to any system receiver device of the present invention that is within the specified transmit range. In addition, the transmitter/transceiver can have a provision for playback audio 9 of the custom alert message, prior to transmitting RF audio 7, using an integrated speaker 18. In this operational mode, the audio switch 5 transmits the custom alert message playback audio 9 for audio out 19 through the speaker 18. In this embodiment of the present invention, the desktop/portable transmitter/transceiver generally derives power from available AC or a separate rechargeable DC battery 17.

Figure 3:
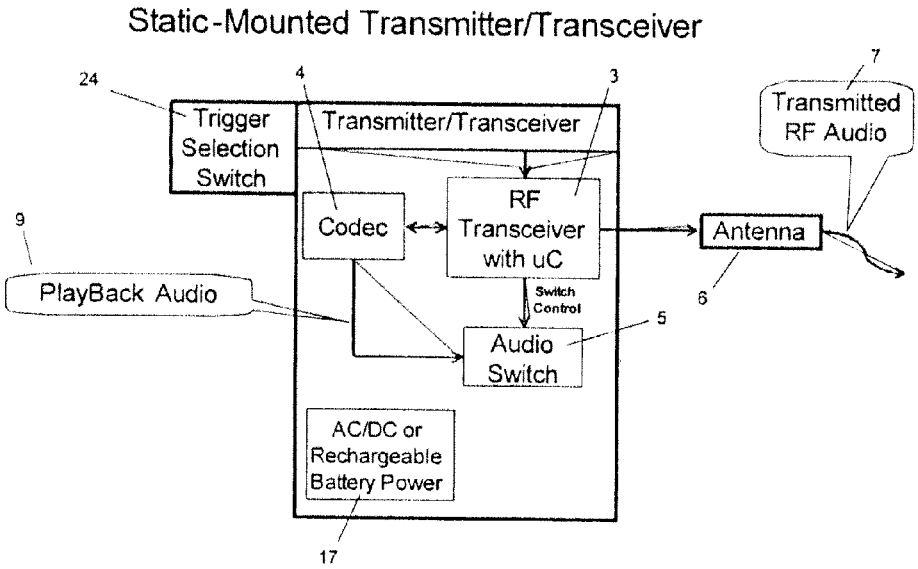
FIG. 3. is a functional block diagram of a Static-Mounted WPAN Embodiment of a Transmitter/Transceiver.

With reference to FIG. 3., a functional block diagram of a static-mounted WPAN embodiment of a transmitter/transceiver is depicted. The static-mounted transmitter/transceiver generally has a trigger selection switch 24, which is either internally triggered by a preset event criteria or remotely triggered by a special event. When the trigger selection switch 24 is triggered a stored pre-programmed alert message is processed through the transceiver/microcontroller (uC) 3, Codec 4 and audio switch 5 to access and playback audio alert message 9 and then transmit RF audio 7 of the same through the antenna 6 to any system receiver device of the present invention that is within the specified transmit range. In this embodiment of the present invention, the static-mounted transmitter/transceiver generally derives power from available AC or rechargeable battery 17.

Figure 4:
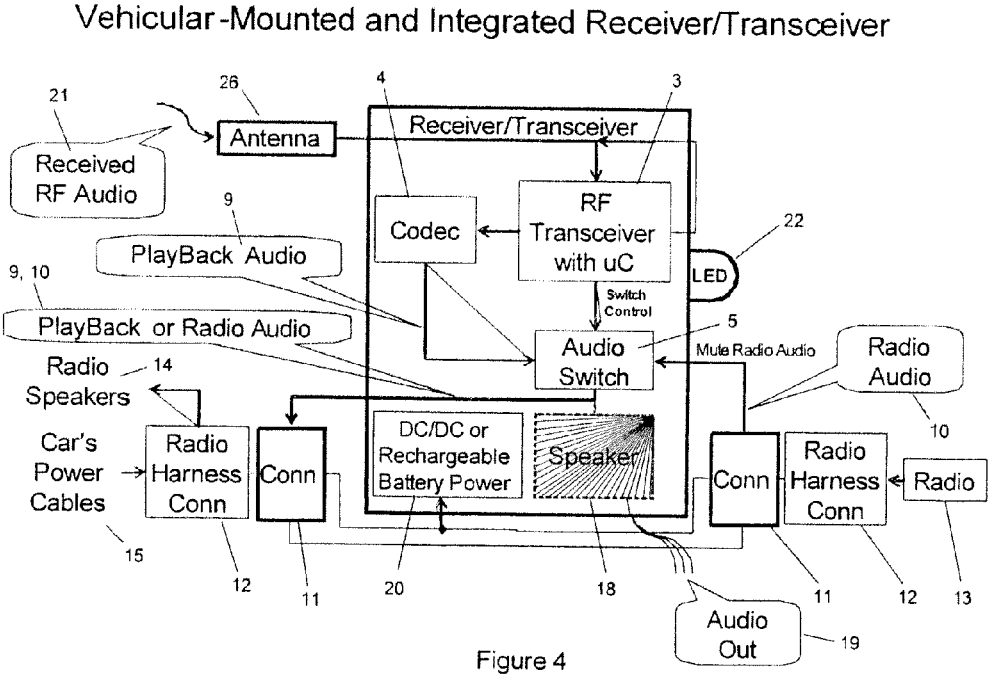
FIG. 4. is a functional block diagram of a Vehicular-Mounted Integrated WPAN Embodiment of a Receiver/Transceiver.

With reference to FIG. 4., a functional block diagram of a vehicular-mounted and integrated WPAN embodiment of a receiver/transceiver is depicted. The vehicular-mounted and integrated receiver/transceiver generally has an antenna 26 for receiving transmissions from any system transmitter/transceiver device of the present invention that is within the specified transmission range. When the antenna 26 receives an RF audio 21 alert message it is processed through the transceiver/microcontroller (uC) 3, Codec 4 and audio switch 5 to then transmit received audio 9 using a vehicle's radio 13. In this operational mode, the audio switch 5, which is connected to the radio 13 at connector 11 through radio wire harness 12, mutes the radio audio 10 and instead transmits the received audio 21 for playback through the radio speakers 14. Alternatively, the audio switch 5, can be connected to an integral speaker 18, to transmit playback audio 9 alert message for playback as audio out 19 through the integral speaker 18. A vehicular-mounted transmitter/transceiver can be provided with a visual indicator feature such as an LED 22, which pulses at varying rates appropriate to the nature of the alert message. In this embodiment of the present invention, the vehicular-mounted transmitter/transceiver generally derives power from available vehicle power, which is connected to the receiver/transceiver DC/DC converter or a separate rechargeable DC battery 20 through connector 11, radio wire harness 12 and car power cables 15.

Figure 5:
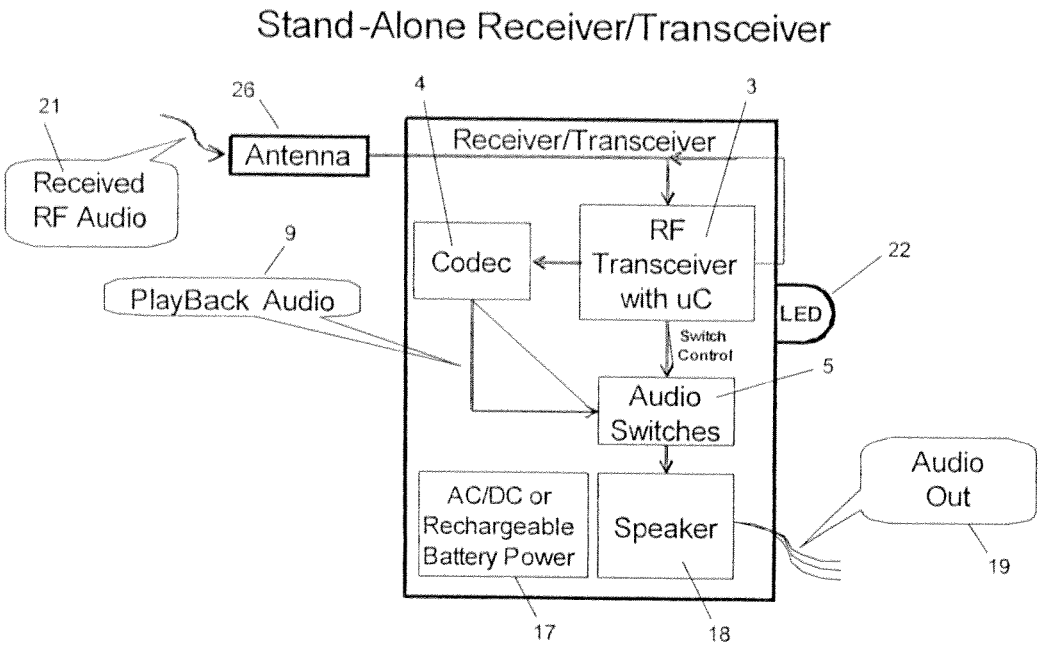
FIG. 5. is a functional block diagram of a Stand-Alone WPAN Embodiment of a Receiver/Transceiver.

With reference to FIG. 5., a functional block diagram of a stand-alone WPAN Embodiment of a receiver/transceiver is depicted. The stand-alone receiver/transceiver generally has an antenna 26 for receiving transmissions from any system transmitter/transceiver device of the present invention that is within the specified transmission range. When the antenna 26 receives an RF audio 21 alert message it is processed through the transceiver/microcontroller (uC) 3, Codec 4 and audio switch 5 to then transmit playback audio alert message 9 for playback as audio out 19 through the integral speaker 18. The static-mounted transmitter/transceiver can be provided with a visual indicator feature such as an LED 22, which pulses at varying rates appropriate to the nature of the alert message. In this embodiment of the present invention, the static-mounted transmitter/transceiver generally derives power from available AC or rechargeable battery 17.

In addition to transmitting at a data rate of up to approximately 500 kilobits per second, to be useful for a wireless notification system, the power of the transmitted signal should be such that a receiver which is at least 50 meters away from the transmitter up to a maximum of approximately 500 meters will properly receive the signal. Additionally, since it is important that the generated audio signal be played back in real time independent of vehicle speed, the digital signal is not compressed.

In this manner, by using the present invention, it is possible to provide a wireless cautioning and early warning and emergency notification system because the transmitted signal travels a distance of at least 50 meters but no more than approximately 500 meters. The 50 meters lower bound is important because if the signal were transmitted only at distances of less than 50 meters, it would not be possible for vehicles moving at normal speeds to be able to receive a useful message in real time. For example, at 50 miles per hour, an audio message being played back in real time would need to be less than 2.5 seconds long. Further, at a data rate of 500 kilobits per second, at a range of under 50 meters, only extremely short non-audio messages could be received. The upper limit of approximately 500 meters is also important to avoid messages being received by vehicles which are a substantial distance away from the device transmitting the warning message. Thus, the range of 50 meters to approximately 500 meters is very important for proper operation of the invention. Although, theoretically, compression could be performed to enable longer messages than could ordinarily be transmitted within the 500 kilobits per second data rate and the 50 meters to approximately 500 meters transmission range, since it is also important that the warning or emergency message be received by a moving vehicle in real time, any compression would be undesirable as this could result in a delay which would occur as the message is being decompressed. Of course, very fast processors could be employed so as to minimize the delay which would occur during any decompression. However, faster processors would unnecessarily increase cost and under certain circumstances, undesirable delay could still exist.

This stand-alone receiver/transceiver embodiment of the present invention may be installed anywhere, including a vehicle, without requiring any interface with the installation location, since it has an integrated antenna and internal power.

Figure 6:
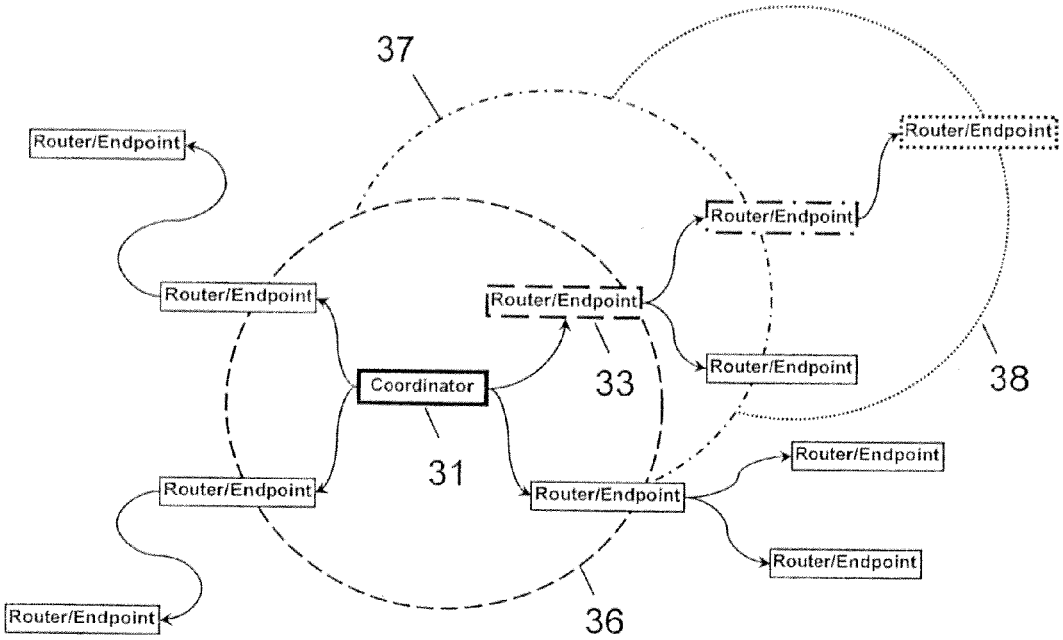
FIG. 6. is a block diagram of a WPAN mesh tree network.

Referring to FIG. 6, transmitters and receivers used in the present invention form a WPAN (Wireless Private Area Network) capable of automatic network formation, self healing or realigning, and network shut down. The network utilizes two hardware types. The first hardware type is Static-Mounted and Vehicle-Mounted Transmitters/Transceivers using a coordinator 31 network type. The second hardware type is Static-Mounted and Vehicle-Mounted Receivers/Transceivers using a router/endpoint 33 network type. A mesh tree network is formed only if there is at least one coordinator and one or more router(s)/endpoint(s). The coordinator will allow a one to many binding so that multiple routers/endpoints may be controlled by one coordinator. Once a router/endpoint has joined a network, other routers/endpoints may join the network through the router/endpoint that has already joined and do not have to be joined directly to the coordinator. This indirect joining of the network puts less stress on the coordinator. This type of mesh network is very flexible and capable of re-configuration as the network physically changes. The size or radius of the network is controlled by the number of hops that a message is allowed to make through the routers. A radius value is included in each message and decremented each time the message is re-transmitted through a router. When the radius reaches a value of zero, the message is not allowed to be re-transmitted through the current router. Suitable coordinator and router/endpoint functionality for this purpose are available from a ZigBee SoC RF Transceiver with Microprocessor with part number SC2430 available from Chipcon/Texas Instruments. The dotted circles indicate ranges from the coordinator to the first group 36 of router/endpoints in direct communication with the coordinator, the second group 37 of router/endpoints in direct communication with router/endpoints of group 36 and a third group 38 of router/endpoints in direct communication with router/endpoints of group 37. The number of "jumps" from the first router/endpoint to another is controlled by the coordinator "transmitter."

To prevent unauthorized access to the system, the system can be implemented using hardware with preconfigured profiles (Cluster/Attribute IDs) which would be the only ones allowed to form or join the network. Cluster/Attribute IDs will be confirmed to ensure a proper network is formed. Security is further established by a 128 bit AES (Advanced Encryption Standard) hardware co-processor. A pair of 128 bit AES keys will be generated and stored in each network device. Only devices with the correct security codes will be allowed to join in the network. Furthermore, all messages including acknowledges may be encrypted prior to RF transmission and decrypted after RF reception. Cluster/Attribute IDs and 128 bit encryption are well known in the art.

A suitable codec for use in the invention is part number TLV320A1C12K available from Texas Instruments.

A suitable transceiver/microcontroller for use in the invention is a ZigBee SoC RF Transceiver with Microprocessor with part number SC2430 available from Chipcon/Texas Instruments.

A suitable transceiver/microcontroller with location functionality for use in the invention is a ZigBee SoC RF Transceiver with Microprocessor and a Location Hardware Core with part number SC2431 available from Chipcon/Texas Instruments.

Increased RF transmission and reception range can be achieved for all ZigBee embodiments of the present invention by incorporating RF output power amplification (PA). A PA suitable for use in the invention is part number MAX2240EBL available from Maxim Integrated Products/Dallas Semiconductor along with other discreet switching and support components or by incorporating exclusively discreet output power amplification components readily apparent to persons skilled in the field of the invention.

The remaining components such as the various switches, microphone, antennas, power supplies and the like are well known components, readily available from numerous sources, the specific details of which are not needed to make and use the invention. Further, the various interconnections of the various components used to form the invention, are readily apparent to persons skilled in the field of the invention, and for that reason, the specific details are not set forth herein.

The invention claimed is:

1. A wireless notification system comprising:

a) a transmitter and microprocessor configured to transmit at a data rate up to approximately 500 kilobits per second limited to a range up to a maximum of approximately 500 meters;

b) a codec coupled to said transmitter and microprocessor, said codec configured to convert an analog audio signal to a digital signal for transmission by said transmitter to a receiver in a vehicle configured to receive said digital signal, and generate an audio signal corresponding to said analog audio signal for playback in said vehicle, wherein said digital signal is not compressed and said generated audio signal is played back in real time independent of vehicle speed.

2. The wireless notification system defined by claim 1 wherein said digital signal is encrypted prior to transmission by said transmitter.

3. The wireless notification system defined by claim 1 wherein said receiver when receiving said digital signal is configured to generate in addition to said audio signal, at least one of a visual signal and a vibration alert signal.

4. The wireless notification system defined by claim 1 wherein said receiver is configured to temporarily mute audio being played in said vehicle.

5. The wireless notification system defined by claim 1 wherein said receiver includes a location determination circuit.

6. The wireless notification system defined by claim 3 wherein said visual signal is one of a LCD, LED, ACTFEL and vacuum fluorescent display.

7. The wireless notification system defined by claim 3 wherein said vibration alert signal is one of a steering wheel and a floor mat mounted vibrator.

8. A wireless notification system comprising:

a) a receiver and microprocessor for use in a vehicle;

b) a codec coupled to said receiver and microprocessor, said codec configured to convert a digital signal from a transmitter received by said receiver to an analog audio signal for playback in said vehicle, and generate an audio signal corresponding to said analog audio signal for playback in said vehicle, said transmitter configured to transmit at a data rate up to approximately 500 kilobits per second limited to a range up to a maximum of approximately 500 meters, wherein said digital signal is not compressed and said generated audio signal is played back in real time independent of vehicle speed.

9. The wireless notification system defined by claim 8 wherein said receiver is configured to temporarily mute audio being played in said vehicle.

10. The wireless notification system defined by claim 8 wherein said receiver includes a location determination circuit.

11. The wireless notification system defined by claim 8 wherein said receiver when receiving said digital signal is configured to generate in addition to said audio signal, at least one of a visual signal and a vibration alert signal.

12. The wireless notification system defined by claim 11 wherein said visual signal is one of a LCD, LED, ACTFEL and vacuum fluorescent display.

13. The wireless notification system defined by claim 11 wherein said vibration alert signal is one of a steering wheel and a floor mat mounted vibrator.

14. A wireless notification system comprising:

a) a transmitter and microprocessor pair configured to transmit at a data rate up to approximately 500 kilobits per second limited to a range up to a maximum of approximately 500 meters;

b) a first codec coupled to said transmitter and microprocessor pair, said first codec configured to convert an analog audio signal to a digital signal for transmission by said transmitter to a transceiver in a vehicle configured to receive said digital signal;

c) a second codec coupled to said transceiver and a microprocessor, said second codec configured to convert said digital signal from said transmitter received by said transceiver to an analog audio signal for playback in said vehicle, and generate an audio signal corresponding to said analog audio signal for playback in said vehicle, wherein said digital signal is not compressed and said generated audio signal is played back in real time independent of vehicle speed.

15. The wireless notification system defined by claim 14 wherein said transmitter and microprocessor pair is configured to initiate new messages.

16. The wireless notification system defined by claim 15 wherein said new messages are initiated by at least one of an automatic, a manual, a remote and multiple condition triggers.

17. The wireless notification system defined by claim 14 wherein said transmitter and microprocessor is disposed at a static location and is configured to be manually overridden by a transceiver and microprocessor pair disposed within said vehicle.

18. The wireless notification system defined by claim 14 wherein said transmitter and microprocessor pair is configured to work in conjunction with traffic control devices.

19. The wireless notification system defined by claim 14 wherein said transceiver is configured to temporarily mute audio being played in said vehicle.

20. The wireless notification system defined by claim 14 wherein said transceiver includes a location determination circuit.

21. The wireless notification system defined by claim 14 wherein said transceiver when receiving said digital signal is configured to generate in addition to said audio signal, at least one of a visual signal and a vibration alert signal.

22. The wireless notification system defined by claim 21 wherein said visual signal is one of a LCD, LED, ACTFEL and vacuum fluorescent display.

23. The wireless notification system defined by claim 21 wherein said vibration alert signal is one of a steering wheel and a floor mat mounted vibrator.

24. The wireless notification system defined by claim 14 wherein said system includes at least said transmitter and microprocessor pair and a plurality of said transceiver and microprocessor pairs, said system forming a wireless private area network, each said transmitter and microprocessor pair and each said transceiver and microprocessor pair configured to transmit a message contained within said digital signal a predetermined number of times in order to limit a range over which said message is transmitted, and wherein a first predetermined number of transmitter and microprocessor pairs are disposed at static locations and a second predetermined number of transceiver and microprocessor pairs are disposed within vehicles.

* * * * *